US009149832B2

(12) United States Patent
Yu

(10) Patent No.: US 9,149,832 B2
(45) Date of Patent: Oct. 6, 2015

(54) CLEANING DEVICE COMPRISING IN-SITU METAL OXIDE DISPERSION

(71) Applicant: XEROX CORPORATION, Norwalk, CT (US)

(72) Inventor: Robert C. U. Yu, Sunnyvale, CA (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/069,733

(22) Filed: Nov. 1, 2013

(65) Prior Publication Data

US 2015/0125177 A1 May 7, 2015

(51) Int. Cl.

| | |
|---|---|
| ***G03G 21/00*** | (2006.01) |
| ***G03G 15/16*** | (2006.01) |
| ***B05D 1/24*** | (2006.01) |

(52) U.S. Cl.

CPC ..... *B05D 1/24* (2013.01); *G03G 21/0017* (2013.01)

(58) Field of Classification Search

USPC ..... 399/350

See application file for complete search history.

(56) References Cited

U.S. PATENT DOCUMENTS

| | | | | |
|---|---|---|---|---|
| 4,264,191 | A | 4/1981 | Gerbasi et al. | |
| 4,563,408 | A | 1/1986 | Lin et al. | |
| 4,864,331 | A | 9/1989 | Boyer et al. | |
| 4,875,081 | A | 10/1989 | Goffe et al. | |
| 5,138,395 | A | 8/1992 | Lindblad et al. | |
| 5,153,657 | A | 10/1992 | Yu et al. | |
| 5,208,639 | A | 5/1993 | Thayer et al. | |
| 2008/0181690 | A1 * | 7/2008 | Watanabe et al. | 399/350 |
| 2012/0020712 | A1 * | 1/2012 | Thayer et al. | 399/351 |
| 2012/0301176 | A1 * | 11/2012 | Ferrar et al. | 399/101 |
| 2012/0301197 | A1 * | 11/2012 | Ziegelmuller et al. | 399/350 |

* cited by examiner

*Primary Examiner* — David Gray
*Assistant Examiner* — Tyler Hardman
(74) *Attorney, Agent, or Firm* — Pillsbury Winthrop Shaw Pittman LLP

(57) ABSTRACT

A cleaning device used in an electrophotographic image forming apparatus that provides excellent wear resistance and mechanical robustness. In particular, the cleaning device is a crosslinked elastomeric polyurethane cleaning blade that includes at least an end region contacting the surface of an imaging member to remove debris therefrom and comprising spherical silica nanoparticles dispersion present in the cleaning blade matrix by in-situ condensation precipitation process.

12 Claims, 4 Drawing Sheets

CLEANING DEVICE COMPRISING IN-SITU METAL OXIDE DISPERSION

BACKGROUND

The presently disclosed embodiments relate in general to an electrophotographic image forming apparatus and its subcomponents, and more particularly to an improved cleaning device that has excellent wear resistance and mechanical robustness and is used to remove or clean the residual toner and other debris from a charge retentive belt or drum surface of an image forming member.

In electrophotographic applications such as xerography, a charge retentive photoreceptor belt or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contacting it with a finely divided electrostatically attractable toner. The toner is held in position on the photoreceptor image areas by the electrostatic charge on the surface. Thus, a toner image is produced in conformity with a light image of the original beam reproduced. Once each toner image is transferred to a substrate, and the image affixed thereto form a permanent record of the image to be reproduced. In the case of multicolor copiers and printers, the complexity of the image transfer process is compounded, as four or more colors of toner may be transferred to each receiving substrate sheet or paper. Once the single or multicolored toner is applied to the substrate, it is permanently affixed to the substrate sheet by fusing so as to create the single or multicolor copy or print. Following the photoreceptor to the receiving substrate toner transfer process, it is necessary to at least periodically clean the charge retentive surface of the photoreceptor. In order to obtain the highest quality copy or print image, it is generally desirable to clean the photoreceptor each time toner is transferred to the substrate. In addition to the removing of excess residual toner, other particles such as paper fibers, toner additives and other impurities (hereinafter collectively referred to as "residue") remaining on the charged surface of the photoreceptor should also be completely removed and cleaned as well prior to the next printing cycle to avoid debris intererence with the recording of next new latent image thereon.

Various methods and apparatus may be used for removing residual particles/debris from the imaging surface of the photoreceptor. For example, a cleaning brush, a cleaning web and a cleaning blade have been utilized; these devices are operated by wiping the imaging surface to effect cleaning. After prolonged service in the machine, however, these devices become contaminated with toner and debris and pre-maturely lose their cleaning efficiency which requires frequent costly replacement in the field. The shortcomings and pre-mature failure of these devices, made way for the development of another prevalent and improved form of cleaning known as elastomeric blade cleaning.

Elastomeric cleaning blades made of rubberlike material and brushes are employed to remove residue/debris from a photoreceptor surface. A typical elastomeric blade, made of inexpensive/low-cost crosslinked polyurethane, is used to scrape residue/debris from the photoreceptor surface. In operation, a rotating cleaning brush may first loosen, dislodge and abrade the unwanted toner and other residue from the photoreceptor surface prior to the subsequent sliding/wiping action of the elastomeric polyurethane blade to clean up the photoreceptor surface and be ready for next latent imaging formation process.

The currently used polyurethane blade in the electrophotographic cleaning process is an isotropic material having a Young's modulus that does satisfactorily meet both the lateral conformability requirement and resonant frequency requirement needed for effective cleaning performance. However, the currently used elastomeric polyurethane blade to clean the residue toners/debris from the surface of an organic photoreceptor belt or drum, has also been found to have certain deficiencies in blade cleaning process which are primarily a result of frictional sealing contact that must occur between the blade and the photoreceptor surface. Dynamic friction is the force that resists the relative motion between these two bodies that come into contact with each other as the photoreceptor is in cyclic motion against the stationary blade. This friction between the blade edge and the photoreceptor surface causes wearing away of the blade edge and damages the blade's intimate contact with the surface, resulting in material failure and eventual loss of the blade's cleaning efficiency. Therefore, a mechanically robust elastomeric polyurethane blade that has improved wear resistance is urgently needed to resolve the issue for functional life extension.

Various approaches have been employed to deal with problems associated with photoreceptor cleaning and oxidation in copying or printing machine environments, including the following disclosures: U.S. Pat. No. 5,208,639, U.S. Pat. No. 5,153,657, U.S. Pat. No. 5,138,395, U.S. Pat. No. 4,875,081, U.S. Pat. No. 4,864,331, U.S. Pat. No. 4,563,408, U.S. Pat. No. 4,264,191, and U.S. Pat. No. 5,208,639, the disclosures of which are hereby incorporated by reference in their entireties.

U.S. Pat. No. 5,208,639, hereby incorporated by reference in its entirety, discloses an apparatus for cleaning residual toner and debris from a moving charge retentive surface of an image forming apparatus. The present embodiment includes a multiple blade holder for selectively indexing each individual blade into position for cleaning the moving photoreceptor. The blade holder contains a number of cleaning blades mounted radially from a central core; by rotating the holder about its longitudinal axis a new cleaning blade is moved by the indexing device into the cleaning position to replace a failed blade. The indexing device removes the failed cleaning blade and positions a new cleaning blade in frictional contact with the photoreceptor for cleaning.

U.S. Pat. No. 5,208,639, hereby incorporated by reference in its entirety, discloses a cleaning blade which is made from a thermoplastic material having a compounded additive for lubrication. The cleaning blade is used in an electrophotographic printing machine to remove residual particles from a photoconductive surface. U.S. Pat. No. 5,153,657, hereby incorporated by reference in its entirety, discloses a blade member impregnated with inorganic particulates dispersed therein so as to reinforce the blade for improving blade life.

U.S. Pat. No. 4,875,081, hereby incorporated by reference in its entirety, discloses a blade member for cleaning a photoreceptor wherein an A.C. voltage is applied to the cleaning blade. Use of the A.C. voltage eliminates the need to bias the blade against the photoreceptor with a high frictional force and thus eliminates impaction of toner on the photoreceptor surface.

U.S. Pat. No. 4,864,331, hereby incorporated by reference in its entirety, discloses an offset electrostatic imaging process which includes the steps: (a) forming a latent electrostatic image on a dielectric imaging member, with the dielectric imaging member being prepared by coating an electrically conductive substrate with a porous layer of a non-photoconductive metal oxide using a deposition process; (b) developing the latent electrostatic image with a developer material which comprises a silicone polymer and from about 0.5 to about 5 percent by weight of a metal salt of a fatty acid; (c) transferring the developed image to an image receiving surface by applying pressure between the dielectric imaging member and the image receiving surface; (d) cleaning the dielectric imaging member using a first cleaning means which is effective to remove developer material residue from about the surface of the porous oxide layer; and (e) further cleaning the dielectric imaging member using a second cleaning means which is effective to remove developer material residue from the pores below the surface of the oxide layer.

U.S. Pat. No. 4,563,408, hereby incorporated by reference in its entirety, discloses an electrophotographic imaging member, which includes a conductive layer, a charge transport layer comprising an aromatic amine charge transport or hydrazone molecule in a continuous polymeric binder phase, and a contiguous charge generation layer comprising a photoconductive material, a polymeric binder and a hydroxyaromatic antioxidant. An electrophotographic imaging process using this member is also described.

U.S. Pat. No. 4,264,191, hereby incorporated by reference in its entirety, describes a laminated doctor blade for removing excess marking material or other material from a surface. The blade comprises a relatively hard layer of a smooth tough material and a relatively soft layer of resilient material.

SUMMARY

Disclosed herein is an apparatus for removing debris from a surface, comprising: a cleaning blade including at least an end region contacting the surface to remove debris therefrom; and nanoparticles in the cleaning blade, wherein the nanoparticles are produced through an in-situ condensation precipitation process.

In embodiments, there is provided an apparatus for removing debris from a surface, comprising: a cleaning blade including at least an end region contacting the surface to remove debris therefrom; and silica nanoparticles in the cleaning blade, wherein the silica nanoparticles are produced through an in-situ condensation precipitation process using the tetraethylorthosilicate.

In further embodiments, there is provided a method for preparing a cleaning blade for removing debris from a surface, comprising the step of: providing a cleaning blade comprising crosslinked elastomeric polyurethane; producing hydrolyzed tetraethylorthosilicate by catalyzing tetraethylorthosilicate with acetic acid in the presence of a stoichiometeric amount of water; adding methylene chloride to the hydrolyzed tetraethylorthosilicate to give a solution containing the hydrolyzed tetraethylorthosilicate; and immersing the cleaning blade in the solution containing the hydrolyzed tetraethylorthosilicate.

BRIEF DESCRIPTION OF THE DRAWINGS

For better understanding, reference is made to the accompanying figures. The following is a brief description of the drawings, which are presented for the purposes of illustrating the exemplary embodiments disclosed herein and not for the purposes of limiting the same.

DETAILED DESCRIPTION

Figure 1:
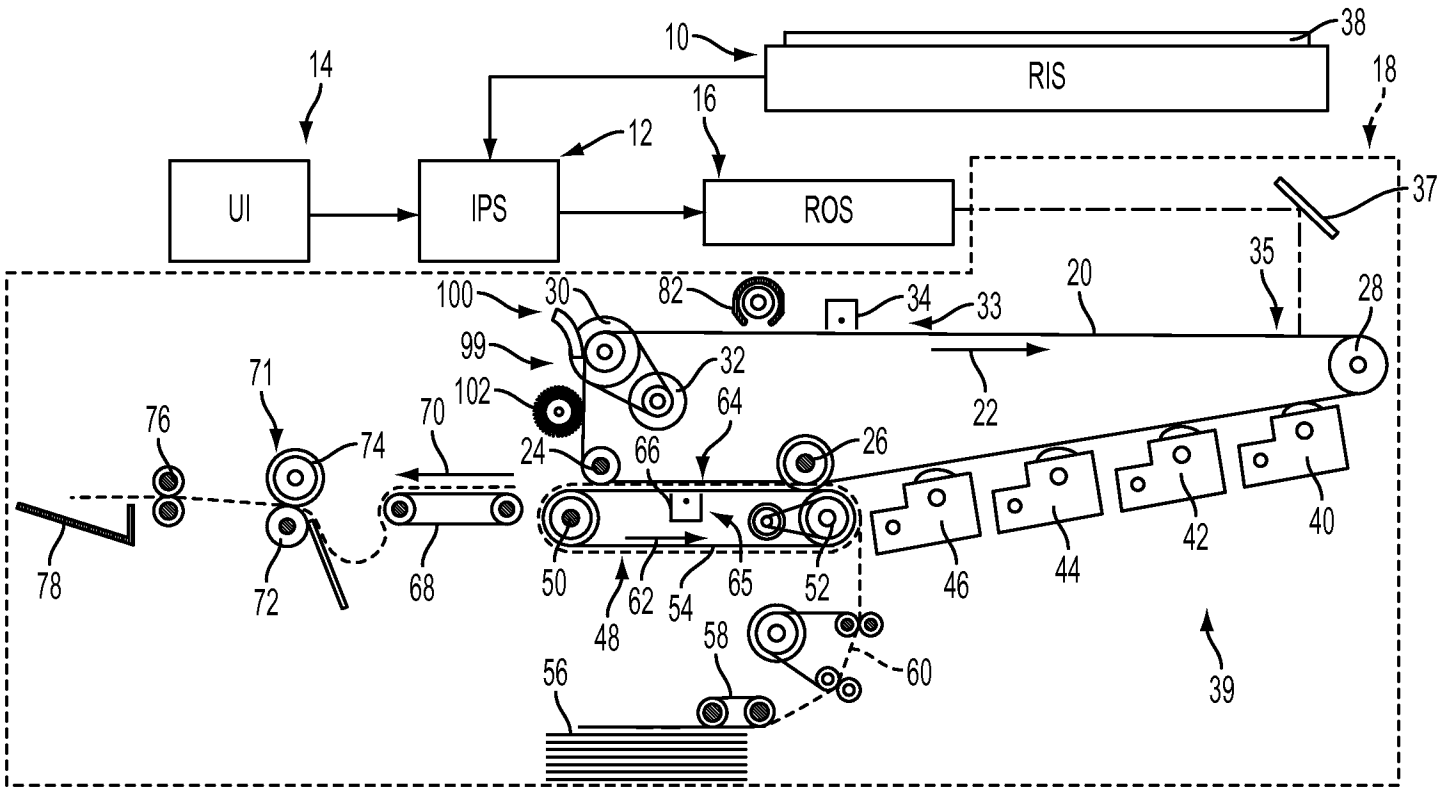
FIG. 1 is a schematic showing an electrophotographic printing machine employing a cleaning blade prepared in accordance with the present embodiments.

The disclosure will be described in detail with reference to the drawings, in which like reference numerals are used to refer to like elements. The various aspects of the present embodiments will become apparent as the following description proceeds and upon reference to the drawings.

While the present embodiments will hereinafter be described in connection with various embodiments, it will be understood that the patent scope is not intended to be limited to any particular embodiment. Rather, the present disclosure is intended to cover all alternatives, modifications and equivalents as may be included within the spirit and scope of the embodiments as defined by the appended claims. It will become evident from the following discussion that the present embodiments set forth herein are suited for use in a wide variety of printing and copying systems, and are not necessarily limited in its application to the particular systems shown herein.

In accordance with one aspect of the present embodiments, there is provided an apparatus for removing debris from a surface including a crosslinked elastomeric polyurethane cleaning blade including at least an end region contacting the surface to remove debris therefrom, wherein the cleaning blade is comprised of silica nanoparticles dispersion in the blade material matrix for wear resistance enhancement.

In accordance with another aspect of the present embodiments, there is provided a printing machine of the type having an imaging receiving surface, including a cleaning blade including at least an end region contacting the surface to remove debris therefrom and comprising nanoparticles dispersion present in the cleaning blade matrix by in-situ precipitation process. In embodiments, the nanoparticles comprise materials selected from the group consisting of oxides of titanium, zirconium, aluminum, tin, silica, and mixtures thereof. The nanoparticles have a spherical shape and a particle diameter of between about 50 and about 500 angstroms. In such embodiments, the cleaning blade has a Shore A hardness of from about 55 to about 65.

In accordance with another aspect of the present embodiments, there is provided a method for preparing a mechanically robust and wear resistance enhanced cleaning blade for removing debris from a surface, comprising the step of treating the cleaning blade by impregnating tetraethylorthosilicate (TEOS) through swelling and de-swelling processes to cause in-situ nano metal oxide particles precipitation, by a chemical condensation reaction, in the blade material matrix.

To begin by way of general explanation, FIG. 1 is a schematic elevational view showing an electrophotographic printing machine which may incorporate features of the present embodiments therein. It will become evident from the following discussion that the present embodiment is equally well suited for use in a wide variety of copying and printing systems, and is not necessarily limited in its application to the particular system shown herein. As shown in FIG. 1, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 1, each developer unit 40, 42, 44 and 46 is shown in the operative position.) During development of each electrostatic latent image, only one developer unit is in the operative position, with the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet is advanced from a stack of sheets 56 disposed on a tray. A friction retard feeder 58 advances the uppermost sheet from stack 56 onto a pre-transfer transport 60. Transport 60 advances a sheet (not shown) to sheet transport 48. The sheet is advanced by transport 60 in synchronism with the movement of the sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt, in synchronism with the toner image developed thereon. In transfer zone 64, a gas directing mechanism (not shown) directs a flow of gas onto the sheet to urge the sheet toward the developed toner image on photoconductive member 20 so as to enhance contact between the sheet and the developed toner image in the transfer zone. Further, in transfer zone 64, a corona generating device 66 charges the backside of the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

Figure 2:
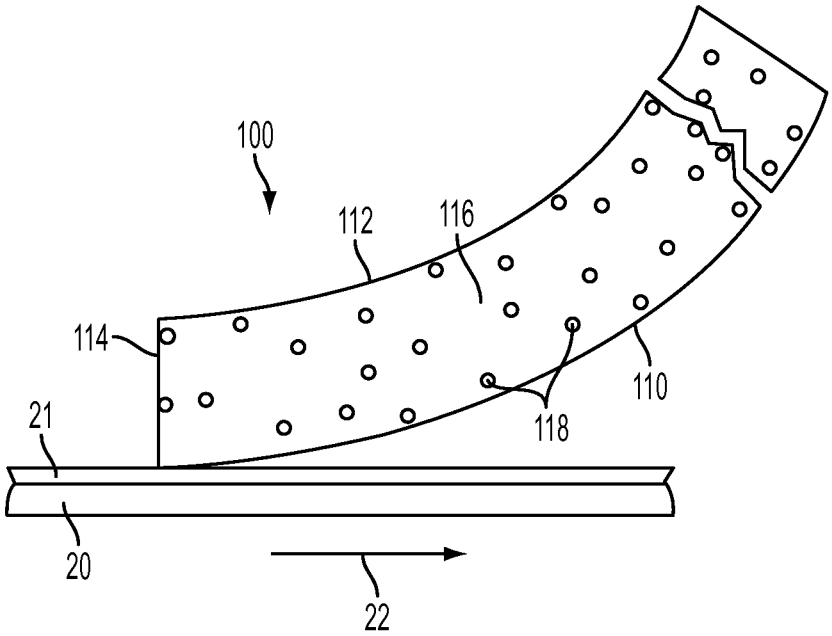
FIG. 2 is a cross-sectional view of a cleaning blade of this disclosure prepared in accordance with the present embodiments.
Figure 4:
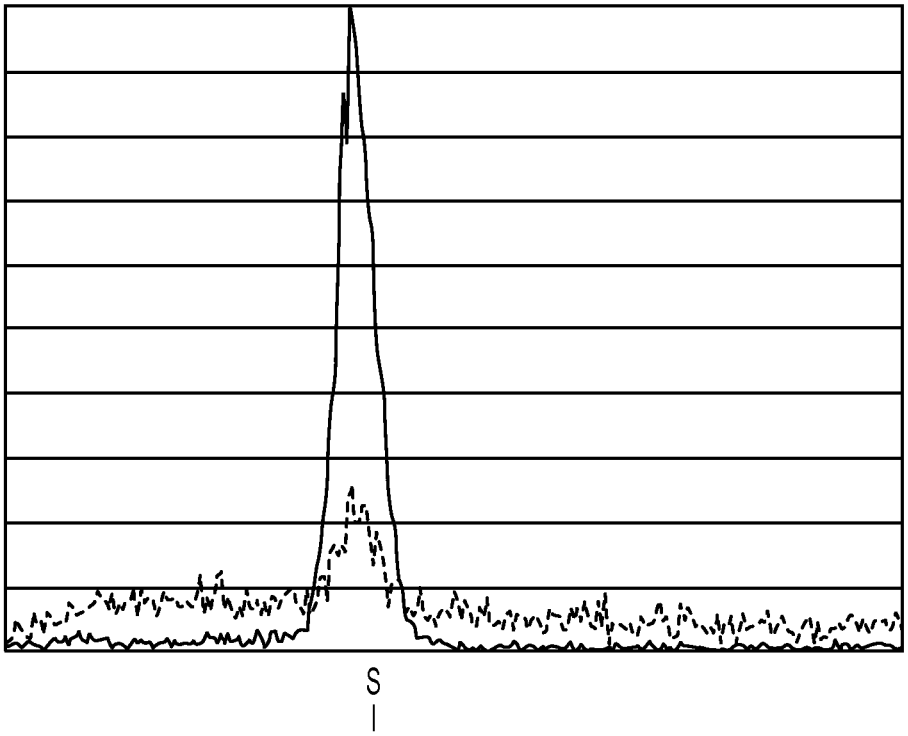
FIG. 4 is a diagram obtained by energy dispersive X-ray analysis (EDXA) confirming the presence of silica nanoparticles dispersion in blade material matrix according to in-sitsu precipitation process described in accordance with the present embodiments.

The final processing station in the direction of movement of belt 20, as indicated by arrow 22, is a photoreceptor cleaning station, indicated generally by the reference numeral 99, and as partially described in greater detail in association with FIGS. 2 and 4. Cleaning blade 100 may serve as the primary or backup means of toner and debris removal. Cleaning blade 100 is shown proximate to corona generating device 34 (as well as other environmental (electrical, mechanical and/or chemical) problem sources such as are addressed by the cleaning blades of the present embodiments. Other aspects and embodiments of the photoreceptor cleaning blades of the present embodiments, such as those as shown and described in association with FIGS. 2 and 4 and Disclosure Example I below, may be employed in cleaning photoreceptors. A rotatably mounted fibrous brush 102 may be positioned in the cleaning station and maintained in contact with photoconductive belt 20 to pre-clean and remove residual toner particles remaining after the transfer operation. Thereafter, lamp 82 illuminates photoconductive belt 20 to remove any residual charge remaining thereon prior to the start of the next successive cycle.

FIG. 2 shows a photoreceptor cleaning blade 100 of this disclosure for removing residual toner and other debris from the charge retentive surface of layer 21 (shown in FIG. 2, on a flat portion of a belt photoreceptor 20). The disclosed cleaning blade 100 is supported adjacent to photoreceptor 20 by a mounting flange or member (not shown). Photoreceptor cleaning blade 100 of the present embodiments provides for the application of a desired uniformly dispersed pressure or contact force for cleaning photoreceptor 20. Photoreceptor cleaning blade 100 may be coupled with an elastomeric cleaning brush 102 as shown in FIG. 1, for removing residual toner and other debris from charge retentive layer 21, Cleaning brush 102 preferably includes a plurality of bristles, which must necessarily be constructed from a material that is softer than the charge retentive surface of photoreceptor 20 so to prevent scratching or other damage to the charge retentive surface. Cleaning blade 100 and cleaning brush 102 preferably extend across the width of photoreceptor 20, so as to cooperatively remove excess matter/debris from layer 21. Cleaning blade 100 is mounted to a supporting structure (not shown) so as to be held in place as shown in FIG. 2.

Photoreceptors can comprise either a single layer or a multilayer belt structure, such as shown in FIG. 2, or a drum structure (not shown). A photoconductive layer (such as layer 21 of photoreceptor 20 in FIG. 2) may be a homogeneous layer of a single material such as vitreous selenium or may be a composite of layers containing a photoconductor. The commonly used multilayered or composite structure contains at least a photogeneration layer, a charge transport layer and a conductive substrate. The photogeneration layer generally contains a photoconductive pigment and a polymeric binder. The charge transport layer (e.g., hole transport layer) contains a polymeric binder and charge transport molecules (e.g., aromatic amines, hydrazone derivatives, etc.). These organic, low ionization potential hole transport molecules as well as the polymeric binders are very sensitive to oxidative conditions arising from photochemical, electrochemical and other chemical reactions.

In copiers electronic printers, although the cleaning blades are frequently exposed to difficult environmental conditions, to include light, charging devices such as corotrons, dicorotrons, scorotrons and the like, electric fields, oxygen, oxidants and moisture, however, pre-mature cleaning blade failure due to early onset of wear damage has been seen to be the primary problem as it affect the blade cleaning efficiency that does directly impact the copy printout quality.

Referring to FIG. 2, printer/copier inboard-outboard line printout defects in receiving copies have been identified to be due to cleaning blade tip material degradation as a result of pre-mature development of wear damage such that the area where cleaning blade 100 in contact with charge retentive layer 21 of photoreceptor 20 (or a photoreceptor drum, not shown) during machine imaging and cleaning process is not intimately maintained. This cleaning blade tip material wear damage is permanent, and will require immediate cleaning blade replacement. Cleaning blade 100 includes a lower surface 110, an upper surface 112 and a lead edge 114; the intersection point of the lower surface 110 and lead edge 114 is the portion of the cleaning blade which most vigorously contacts charge retentive layer 21 of photoreceptor 20. As photoreceptor 20 moves in direction 22, residual toner and other excess debris is removed from photoreceptor 20. To resolve the cleaning blade 100 functioning failure issue caused by wear, the polyurethane blade body material matrix 116 of cleaning blade 100 is impregnated with silica nanoparticles dispersion 118 (shown in representative fashion in FIG. 2) which is produced by in-sitsu precipitation process of tetraethylorthosilicate (TEOS) through condensation reaction according to the methodology described in the present disclosure.

Cleaning blade 100 may otherwise be impregnated with alternative metal oxides, such as for example, of Ti, Al, Cr, Sn, Fe, Mg, Ni, Cu, and the like. These metal oxides may be formed from metal alkoxides or aryloxides of the formula $M(OR)_4$, where M is a metal and R is an alkyl group having from 1-20 carbon atoms, phenyl or benzyl. The metal oxides are obtained by a sol-gel processing method. In this sol-gel process, a sol is obtained by suspending the metal alkoxide or aryloxide $M(OR)_4$ in an alcohol/aqueous medium in the presence of a catalyst. The metal alkoxide or aryloxide $M(OR)_4$ then undergoes hydrolysis and then condenses into a gel structure. The gels can then subsequently be condensed to form homogeneously precipitated nano metal oxide particles dispersion in the cleaning blade material matrix. However, for the reason of simplicity and the ease of understanding, the present disclosure will only be focused and represented by in-sitsu nano silicon dioxide (silica) particles precipitation in the elastomeric polyurethane cleaning blade.

The typical silica nanoparticles obtained by the condensation/precipitation process are spherical in shape and have a particle size of between about 50 and about 500 angstroms in diameter. The preferred silica nanoparticle loading level is between about 2 and about 8 weight percent based on the total weight of the resulting cleaning blade prepared according to the process of present disclosure.

Figure 3:
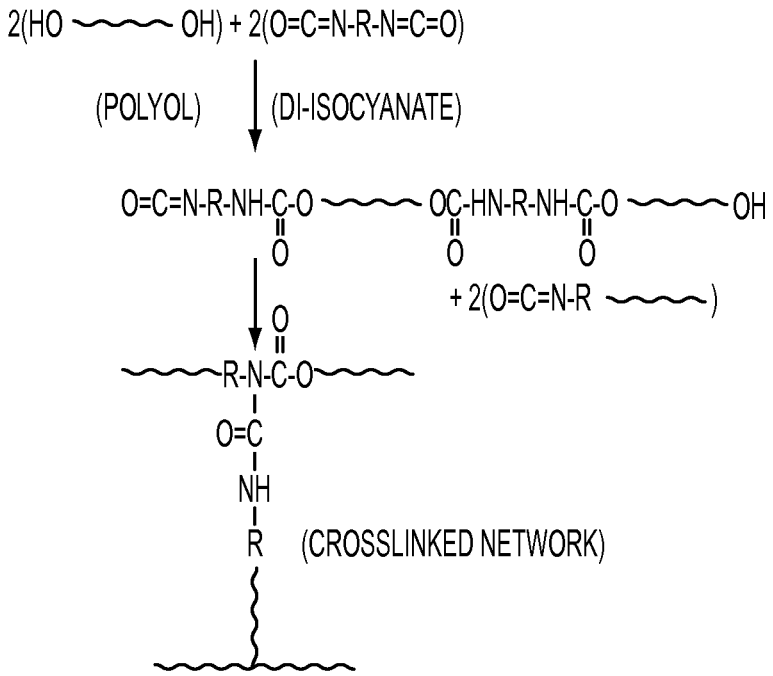
FIG. 3 is a diagram showing a chemical constituent of a crosslinked polyurethane network structure of a cleaning blade prepared in accordance with the present embodiments.

FIG. 3 describes chemical constituents and the chemical reactions involved leading to the formation of a typical crosslinked polyurethane network structure of an exemplary photoreceptor cleaning blade of conventional design in the prior art. In the resulting cleaning blade thus prepared according to the present disclosure process, the presence of nano size silica particles was confirmed by energy dispersive X-ray analysis (EDXA) shown in FIG. 4. The homogeneity silica particles dispersion without agglomeration in the material matrix of the blade was evident by further transmission electron microscope (TEM) examination.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

Examples

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments is being indicated by the appended claims rather than the foregoing description. All changes that come within the meaning of and range of equivalency of the claims are intended to be embraced therein. All proportions are by weight unless otherwise indicated.

The methodology and process of treating the cleaning blade with TEOS and its associated chemical reaction leading to the silica nanoparticles dispersion by in-situ chemical condensation/precipitation process are adopted according to the description of the present disclosure and will be fully demonstrated in the Working Examples hereinafter.

Control Example

Untreated Cleaning Blade

An elastomeric polyurethane cleaning blade was prepared by reacting liquid components of a prepolymer polyol (HO . . . OH) with a di-isocyanate crosslinker (O═C═N—R—N═C═O, where R is an aliphatic or aromatic functional) to form a crosslinked three-dimensional network elastomer. The crosslinking reaction, upon mixing the two liquid components, leads to the formation of a thermoset polyurethane elastomer, generally described and shown in FIG. 3.

Disclosure Example I

Nano Silica Dispersed Cleaning Blade

The methodology and process of treating the cleaning blade with TEOS and its associated chemical reaction leading to the silica nanoparticles dispersion in the cleaning blade material matrix, by in-situ chemical condensation/precipitation process, is fully demonstrated hereinafter. An elastomeric polyurethane cleaning blade was prepared in the same manner according to the Control Example, and was then impregnated with homogeneous nano silica dispersion in its material matrix according to the following three processing steps:

A 120.6 grams pre-made solution [containing 83.4 grams of high boiler liquid tetraethylorthosilicate (TEOS, having molecular formula $Si(OC_2H_5)_4$ and available from Petrarch Systems, Inc.), 2 grams of tetrabutyl phosphonium bromide, 28.38 grams of stoichiometric amount of distilled water, and 8.4 grams reagent grade acetic acid catalyst] was prepared by thorough mixing. The prepared hydrolyzed TEOS solution was added to a container of 3,039 grams of methylene chloride with agitation to give a final solution containing the hydrolyzed TEOS species ready for cleaning blade swelling process.

The polyurethane blade weighing 12.0321 grams was then submersed in the prepared final solution and permitted to absorb the solution. As the polyurethane blade was submersed in contact with the solvent of TEOS/methylene chloride solution, it would continuously absorb the solution until the increase in elastic free energy due to the three dimensional isotropic expansion of the polyurethane network was offset by (balanced with) the decrease in free energy due to mixing of polymer chain and this solution; at this state swelling of the blade stops so the condition of swelling equilibrium was reached.

At this swelling equilibrium state, the swollen polyurethane blade (weighing 40.1432 gms) was removed from the solution and then allowed to de-swell by drying it at room ambient for at least 10 hours. Since the hydrolyzed TEOS was non-volatile, the polyurethane blade was further dried under vacuum for 3 hours to remove trace amounts of methylene chloride and effect the in-situ precipitating process of silica nanoparticles by condensation reaction according to the chemical reaction equation shown below:

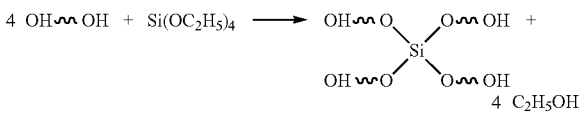

This chemical reaction indicates that, in the presence of acetic acid catalyst, the amount of water needed to hydrolyze the TEOS in the solution is in the molar ratio of 4 water to 1 TEOS for effecting the condensation precipitation of silica nanoparticles in the material matrix of the blade.

In the resulting cleaning blade obtained after the process, the presence of nano size silica particles was confirmed by energy dispersive X-ray analysis (EDXA) shown in FIG. 4. The homogeneity of silica particles dispersion, having spherical in shape and without agglomeration in the material matrix of the blade, was also evident using a transmission electron microscope (TEM) at 50,000 times magnification. The average particle diameter of the precipitated silica was approximately 215 Angstroms. The total amount (by weight percent) of silica nanoparticles impregnation in the blade after the swelling/de-swelling process was then determined. It was calculated by dividing the increase in weight (weight difference between the resulting silica precipitated cleaning blade and weight of the original blade prior to blade treatment) by weight of the resulting cleaning blade of this disclosure to give 3.14% wt, based on the total weight of the resulting disclosed blade.

Cleaning Blade Dynamic Machine Print Testing

The polyurethane cleaning blades prepared according to the Control Example and the Disclosure Example I were each tested in extended duration trials in a xerographic printer/copier. The standard testing procedures included a total daily copy volume of 800 to 1000 copies per day. At the beginning and end of each day a 30% solid area coverage halftone pattern was made to observe the condition of the photoreceptor with respect to cleaning blade lines. The test environment was under the lab ambient and allowed to fluctuate through a normal office daily cycle of approximately 68° F./40% RH to approximately 75° F./50% RH. The result of machine print test ran had shown that the Control Example blade was found to cause the development of copy printout defects corresponding to the wear pattern observed in the blade tip (damage that causes blade contact to the surface of the photoreceptor) after about 55,000 prints. In sharp contrast, the 3.15% wt silica impregnated blade of the Disclosure Example showed no noticeable print defects after reaching the same copies of printout volume. Microscopy examination of these two blades after machine testing, at 50× magnification, found that the control blade had sustained substantial blade tip wear damage preventing it from making intimate contact over the photoreceptor surface for effective cleaning. In contrast, little to no notable blade tip wear was seen for the silica loaded cleaning blade prepared according to this disclosure.

In summary, the machine cleaning blade print test results demonstrated the effectiveness of the presence of silica particles dispersion, prepared according to this disclosure approach, for eliminating blade wear failure problem. It is also important to mention that the presence of silica particles dispersion in the blade did not cause any undesirable effect on the blade cleaning efficiency, and very specifically, it did not cause any change in its mechanical performance; particularly, having a satisfactory shore A hardness in a range of from about 55 to about 65. In other words, the presence of silica nanoparticles in the cleaning blade material matrix proved to provide significant wear resistance enhancement as compared to that seen for the control blade during photoelectrical imaging and cleaning processes, thus eliminating the blade wear failure issue and effectively extending its service life in the field.

While the present embodiment has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An apparatus for removing debris from a surface, comprising:

a cleaning blade including at least an end region contacting the surface to remove debris therefrom, wherein the cleaning blade comprises crosslinked elastomeric polyurethane; and nanoparticles in the cleaning blade, further wherein the nanoparticles are produced through an in-situ condensation precipitation process comprising hydrolyzing tetraethylorothosilicate in the presence of a stoichiometric amount of water to give a hydrolyzed tetraethylorthosilicate, and contacting the cleaning blade with the hydrolyzed tetraethylorthosilicate;

wherein the nanoparticles are homogeneously dispersed in the cleaning blade.

2. The apparatus of claim 1, wherein the nanoparticles comprise materials selected from the group consisting of oxides of titanium, zirconium, aluminum, tin, silicon (silica), and mixtures thereof.

3. The apparatus of claim 1, wherein the nanoparticles are present in the cleaning blade in an amount of from about 2 to about 8 percent by weight of the total weight of the cleaning blade.

4. The apparatus of claim 1, wherein the cleaning blade has a Shore A hardness of from about 55 to about 65.

5. The apparatus of claim 1, wherein the cleaning blade comprising the nanoparticles exhibits less blade damage than a cleaning blade without the nanoparticles after 55,000 prints or more.

6. The apparatus of claim 1, wherein the nanoparticles are spherical in shape.

7. The apparatus of claim 1, wherein the nanoparticles present in the cleaning blade have a particle diameter of between about 50 and about 500 angstroms.

8. An apparatus for removing debris from a surface, comprising:

a cleaning blade including at least an end region contacting the surface to remove debris therefrom, wherein the cleaning blade comprises crosslinked elastomeric polyurethane; and silica nanoparticles in the cleaning blade, further wherein the silica nanoparticles are produced through an in-situ condensation precipitation process comprising hydrolyzing tetraethylorothosilicate in the presence of a stoichiometric amount of water to give a hydrolyzed tetraethylorthosilicate, and contacting the cleaning blade with the hydrolyzed tetraethylorthosilicate;

wherein the nanoparticles are homogeneously dispersed in the cleaning blade.

9. The apparatus of claim 8, wherein the silica nanoparticles are spherical in shape.

10. The apparatus of claim 8, wherein the silica nanoparticles present in the cleaning blade have a particle diameter of between about 50 and about 500 angstroms.

11. The apparatus of claim 8, wherein the cleaning blade has a Shore A hardness of from about 55 to about 65.

12. The apparatus of claim 8, wherein the cleaning blade comprising the nanoparticles exhibits less blade wear damage than a cleaning blade without the nanoparticles after 55,000 prints or more.

* * * * *